United States Patent [19]

Miceli

[11] Patent Number: 4,947,826

[45] Date of Patent: Aug. 14, 1990

[54] CHIMNEY AND FIREPLACE CONSTRUCTION

[76] Inventor: Joseph J. Miceli, 7902 Limoges Dr., Jacksonville, Fla. 32210

[21] Appl. No.: 464,329

[22] Filed: Jan. 12, 1990

[51] Int. Cl.[5] ..... F24B 7/00

[52] U.S. Cl. ..... 126/529; 126/307 R; 126/312; 98/48

[58] Field of Search ..... 126/307 R, 312, 515, 126/529, 528, 530, 531, 533; 98/48, 58, 60

[56] References Cited

U.S. PATENT DOCUMENTS 2,916,983 12/1959 Kinkead ..... 126/307 R
3,538,909 11/1970 Migues ..... 126/529
3,998,203 12/1976 Jensen ..... 126/529
4,329,976 5/1982 Jackson ..... 126/307 R

*Primary Examiner*—James C. Yeung
*Attorney, Agent, or Firm*—Thomas C. Saitta

[57] ABSTRACT

Elongated, vertical air chambers having an open upper end and a closed lower end are located within or attached to the walls of a fireplace, where the upper ends open only into the interior of the fireplace. Air heated within the air chambers rises into the fireplace to increase the drafting efficiency, and is replaced in the air chambers by relatively cooler, draft inhibiting air drawn only from the upper interior of the fireplace. In large furnace applications, the air chambers are located in the lower portion of the chimney.

15 Claims, 4 Drawing Sheets

CHIMNEY AND FIREPLACE CONSTRUCTION

BACKGROUND OF THE INVENTION

This invention relates to the field of chimney and fireplace constructions in general, and more particularly, to the field of chimneys and fireplaces having internal chambers to increase the drafting effects of the chimney or fireplace.

In any situation where incineration or burning is to take place inside a building, such as in foundries, mills, trash incinerators or home fireplaces, it is necessary to provide conduit means for removal of the smoke, gases and excess heat outside of the building. The most common mechanism is to provide a chimney structure. Since the incineration process creates a heat differential, drafting occurs because the hotter air will rise and exit out the top of the chimney. In constructing incinerators, furnaces or fireplaces, the size of the firebox area and the amount of draft required must be taken into effect when designing the size and structure of the chimney. The chimney must be able to draw out and remove all of the smoke and gases or the fireplace or incinerator cannot function in a house or factory.

A typical furnace set-up in a factory involves a large firebox area where high temperature combustion on a large scale occurs. Chimneys must be large volume and substantial in height to remove the smoke, gases and excess heat. Since the principle behind the drafting effect is the temperature differential, these large chimneys encounter problems in efficient drafting due to the temperature drop as the distance from the firebox increases. An additional problem is the build-up of soot, creosote or other by-products on the interior of the chimney, caused by the adherence of these by-products to the relatively cooler upper walls of the chimney. Periodic shut down of the furnace or incinerator is required to remove these hazardous flammable materials from the chimney.

A home fireplace must both contain the fire and draw the smoke up through the chimney to the outside. Efficiency in removing the smoke is of prime importance, and fireplace constructions involve specific dimensional relationships between the different components parts to insure that the job is accomplished. The size of the firebox area, the smoke chamber and the chimney flue are all related. Improper ratios among the components will reduce the efficiency of the fireplace. Other factors which affect the drafting ability of a fireplace, as well as incinerators and furnaces, are atmospheric conditions and materials. For example, high altitude locations require certain adjustments due to lower barometric pressure. A fireplace that drafts well at sea level may not draft effectively in the mountains. The materials used in construction also affect the drafting efficiency of a fireplace. Since drafting is a result of the heated air rising through the chimney and exiting the building, a fireplace constructed all or in part of metal will be a "colder" fireplace than one made of refractory brick or ceramics, and will draft less effectively. The refractory materials will remain warmer than the metal, thus contributing to heating the air even in the smoke box and chimney areas.

Because of economic factors and ease of construction, many builders now prefer metal fireplace units over refractory material fireplaces. As stated, this can result in problems due to inadequate drafting, which are especially aggravated in high altitude or multi-story applications. Furthermore, such metal constructions are more hazardous due to corrosion effects, and fire code restrictions are being added in many areas.

It is known to increase drafting in home fireplaces by creating hollow walls in the firebox materials, such hollow portions opening into the smoke chamber or chimney and having vents which open into the internal room to draw in air. See, for example, U.S. Pat. No. 710,226 to Vitti. The heat in the firebox warms the hollowed walls and rising heated air exits through the chimney, and this heated air is replaced by drawing cool air from the room through the vents. This method is not desirable since the air drawn from the room through the vents vastly decreases the overall heating efficiency of the fireplace. Furthermore, the air drawn in is not heated to as high a temperature as desired, since only a slight temperature difference over the outside air temperature will result in the drafting effect. Thus the air added to the smoke chamber or chimney area will not be of high enough temperature to greatly affect the drafting ability of the fireplace, and the lower temperature air contained in the fireplace itself is not affected. Also, large hollow portions will reduce the strength of the structural materials, which means that the fireplaces must be constructed of small size.

This invention solves the problems outlined above by providing a number of vertical air chambers within the walls of the firebox area or the lower chimney itself which are not vented outside the firebox or chimney. The air chambers open only into the smoke chamber or chimney, thus insuring that only high temperature air is added to the drafting flow coming from the main firebox, since there is no channelling of outside air into the system. The heated air rising from the air chambers is replaced by the relatively cooler, draft inhibiting air contained within the fireplace itself. The heating efficiency of the fireplace is not affected since no additional air is removed from the room. The air chambers are elongated vertically to maximize their volumes while at the same time not detracting from the overall strength of the structure. Because the air chambers supply high temperature air to the smoke chamber or chimney to increase the draft, problems associated with altitude and atmospheric pressure are alleviated. Additionally, fireplaces can be constructed with the lower portions made of refractory materials while constructing the chimneys out of cost-effective and light-weight metal, since the added drafting compensates for the "cold" material. The air chambers also act to insulate the exterior walls of the firebox itself by acting to disperse the internal heat built up within the walls.

It is an object of this invention to provide a means for increasing the drafting ability of a fireplace or furnace chimney by the use of vertical air chambers contained within the walls of the firebox or lower chimney.

It is a further object to provide such means which does not draw cool air from inside the building.

It is a further object to provide such means where the air chambers open only into the smoke chamber or chimney area.

It is a further object to provide such means within either modular pre-constructed fireplace assemblies or on-site, handbuilt fireplaces.

It is a further object to provide vertical air chambers to increase drafting as an add-on feature to existing fireplace or furnace constructions.

BRIEF SUMMARY OF THE INVENTION

The invention comprises an improved fireplace or chimney construction whereby a number of elongated vertical air chambers are located within the walls of the firebox or chimney. The air chambers are open only at the top, the openings being internal to the fireplace or chimney, so that air heated within each chamber rises and exits into the smoke chamber of the fireplace or the chimney, thereby increasing the temperature of the air and smoke in the smoke chamber and chimney, which increases the drafting effect to more efficiently remove the smoke from the firebox and completely out through the chimney. Since the only opening to the air chambers is at the top of each chamber, the air drawn into the chamber to replace the heated air rising out of the chamber is air in the smoke chamber or chimney which is cooler relatively to the air coming from the air chambers. Thus, the problem air, i.e., the relatively cooler air which inhibits drafting and allows soot, creosote and other by-products to adhere to the walls of the chimney, is exchanged for higher temperature air which increases drafting efficiency and maintains the chimney walls at a higher temperature to prevent by-product accumulation. The heat exchange effect of the air chambers also acts to reduce the wall temperatures of the firebox or chimney, thus maintaining the outside wall temperatures at desirable lower temperatures.

The air chambers are preferably cylindrical in shape with narrow diameter so as not to decrease the structural strength of the firebox, furnace or chimney walls. The particular size and number of the air chambers is related to the thickness of the walls, with an increase in number being preferable to an increase in size. The air chambers are situated within the walls as close as practicable to the interior walls to increase the heating effect. The air chambers can also be created in already existing fireplaces by adding on metal pipes, closed at the bottom with open tops extending above the firebox area.

DETAILED DESCRIPTION OF THE INVENTION

Figure 1:
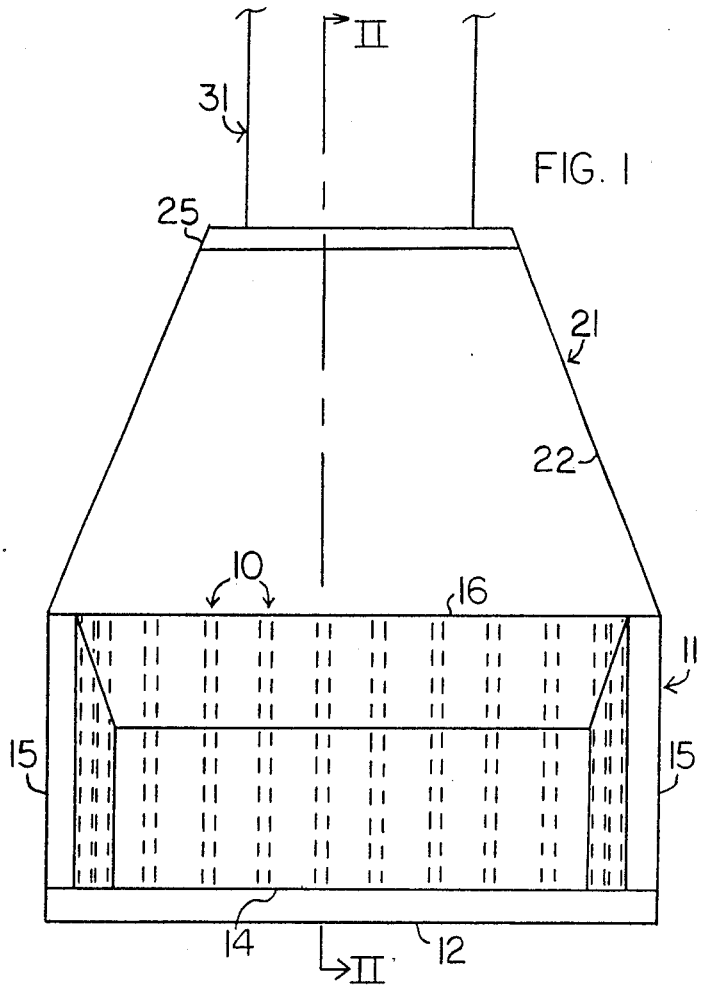
FIG. 1 is a front view of a typical fireplace, with the positions of the air chambers illustrated.
Figure 3:
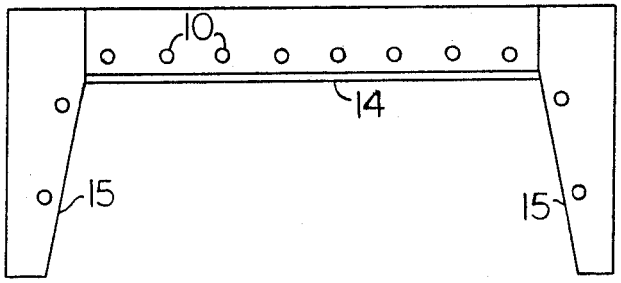
FIG. 3 is a top view of the firebox showing the air chamber openings.
Figure 2:
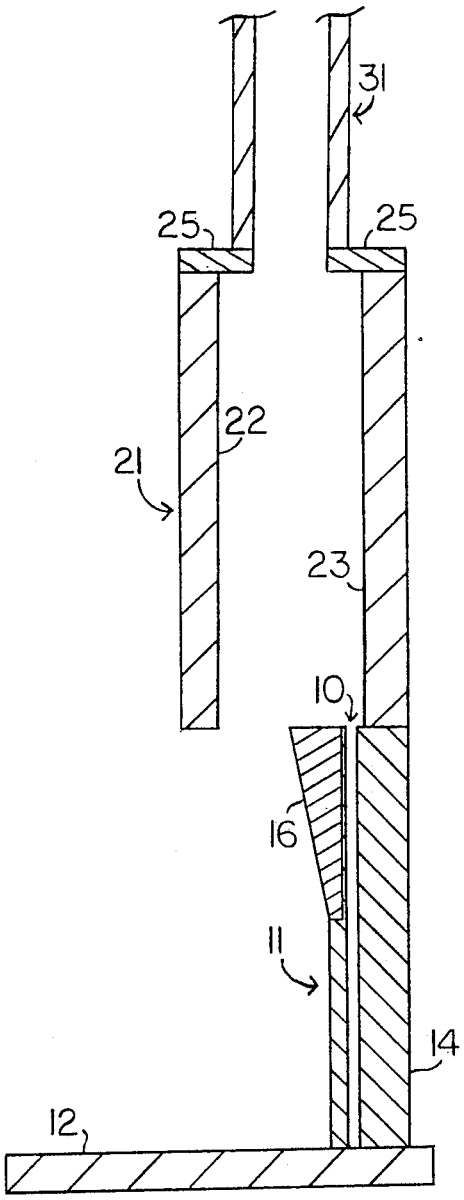
FIG. 2 is a cross-section taken along vertical line II—II of FIG. 1, as seen from the side, showing one of the air chambers in the firebox.

With reference to FIGS. 1 through 3, a typical fireplace construction is shown. The fireplace is comprised of three major components, the firebox 11, the smoke chamber 21 and the chimney flue 31. The fireplace can be of a type hand-constructed on-site, or preferably, can be a pre-fabricated modular unit assembled on-site using standard mortar techniques or metal rods. Firebox 11 surrounds and contains the fire and burning materials, insulating the surrounding building structure from fire and excessive heat. Firebox 11 rests on the hearth 12 and is substantially C-shaped, having a rear wall 14 and two lateral walls 15. Additionally, baffle 16, an angled heat reflector, rests on a ledge against the upper portion of rear wall 14. Firebox 11 is constructed of a fire-proof, insulating, high-strength material such as refractory cement, brick or pumice aggregate. Preferably, the pumice aggregate material is used, as this material is lighter in weight than the others but has increased fire resistance and structural strength, as well as being a better heat reflective material. The entire fireplace can be constructed entirely of refractory materials, or portions can be made of metal for cost and weight savings.

Situated directly above the firebox 11 is smoke chamber 21. Smoke chamber 21 is a relatively large enclosed area having an ingress for air and smoke from the firebox 11 and an egress for air and smoke into the chimney 31. Smoke chamber 21 comprises a front wall 22, a rear wall 23 and two side walls 24. Smoke chamber 21 prevents smoke spillage or return because of its volume and its narrowing configuration from bottom to top. Chimney 31 is connected to smoke chamber 21 and is the conduit for the smoke and hot air from the smoke chamber 21 to the outside of the building.

The improvement comprises the addition of a number of vertically elongated air chambers 10 located in the rear wall 14 and side walls 15 of the firebox 11. The air chambers 10 are preferably cylindrical in shape and approximately one inch in diameter. The air chambers 10 are hollow and are open only at the top of the firebox 11. The air chambers 11 are structured so as to be heated by the transfer of heat from the fire through the walls of the firebox 11, so they are to be located as near to the inside of the firebox 11 as is structurally practicable. For example, in a rear wall 14 six inches thick, the air chambers 10 are preferably placed roughly one inch from the interior. The upper ends of the air chambers 10 preferably open directly into the smoke chamber 21, but an alternative construction where the air chambers are extended upward into the actual chimney area is also possible. This extension can be accomplished either within the walls of the smoke chamber 21 or by adding metal pipe extensions at the top of the firebox 11.

The numerous air chambers 10 increase the drafting ability of a given fireplace by supplying a quantity of high temperature air directly into the smoke chamber 21, where this high temperature air immediately rises into and through the chimney 31, thus increasing both the flow rate and the volume of air and smoke drawn from the firebox 11. Because the air chambers 10 are not open to the outside of the fireplace, only relatively cool air from the smoke chamber 21 is drawn down into the air chambers 10 to replace the high temperature air rising from their interiors. Thus, with regard to increasing the drafting ability of the fireplace, the relatively inefficient cooler air in the smoke chamber 21 is replaced by higher efficiency high temperature air. Because the air chambers 10 are not vented to the outside, no interior room air is withdrawn and only high temperature air flows from the air chambers 10.

The actual number of air chambers 10 and the specific size of each is a function of the size of the fireplace. The more air chambers 10 present in a given fireplace, the greater the improvement in drafting. For example, a standard 36 inch fireplace should have approximately twelve air chambers 10 with approximate one inch diameters. In applications with larger fireplaces, it is better to increase the number of air chambers 10 rather than to greatly enlarge their size. Increased size reduces the overall structural strength of the firebox 11, and a larger total volume of high temperature air is best supplied by increasing the number of air chambers 10. A circular cross-section is preferred for ease of construction and strength considerations, but other cross-sectional shapes could be substituted without losing the beneficial effects.

Figure 4:
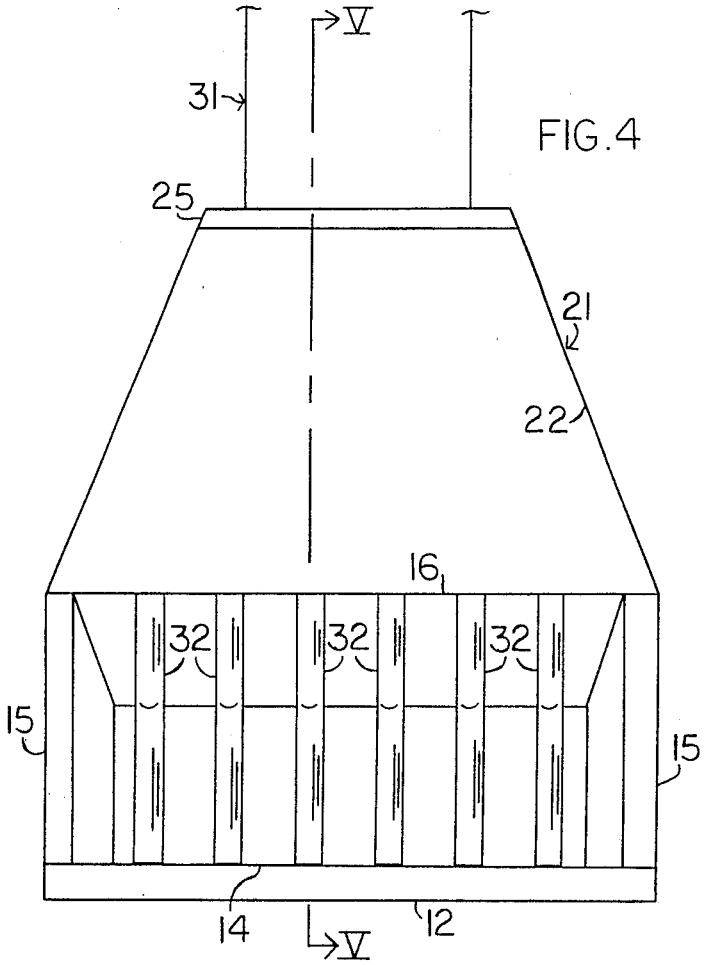
FIG. 4 is a front view of a fireplace showing the air chambers formed by attached metal pipes.
Figure 5:
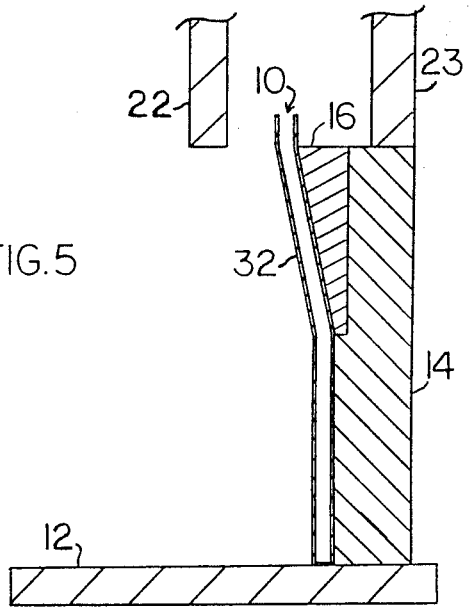
FIG. 5 is a cross-section taken along vertical line V—V of FIG. 4, as seen from the side.

In an alternative embodiment, the vertical air chambers can be added to pre-constructed fireplaces, as shown in FIGS. 4 and 5. Metal pipes 32, closed at the bottom and open at the top, are affixed to the rear and side walls of the existing firebox by suitable fastening means. The upper ends of the pipes 32 extend a distance into the smoke chamber 21 such that only relatively cool air is drawn into the air chambers 10 when heated air rises from the interior of the chambers to increase the draft. The metal pipes 32 can be independently attached or can be constructed as an integral unit and then inserted and affixed.

Figure 6:
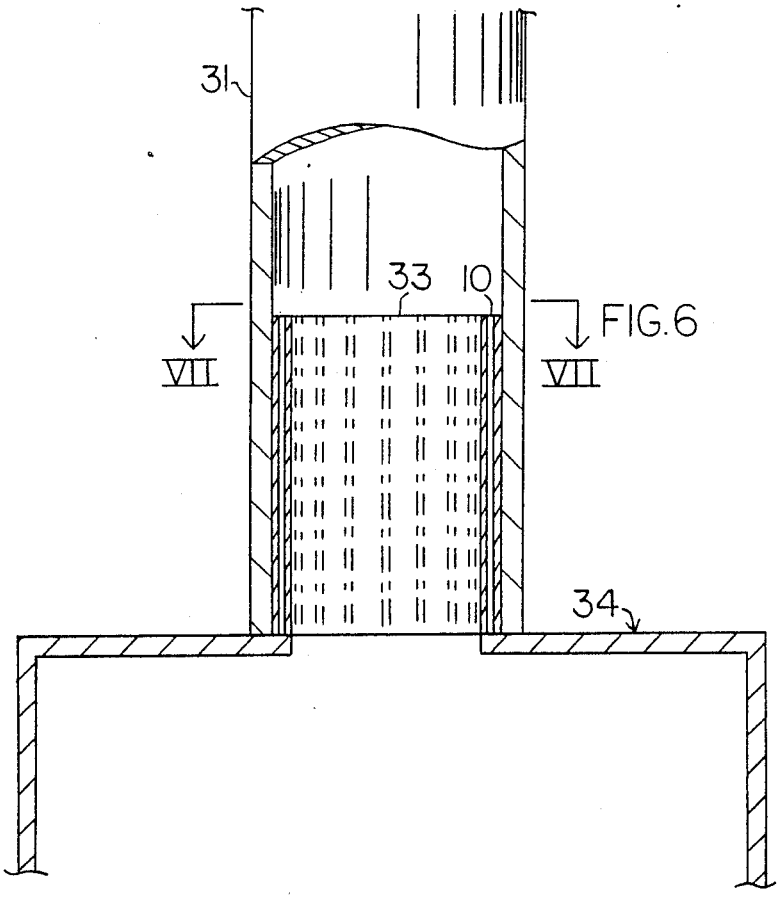
FIG. 6 is a sectional view of a furnace and chimney showing the positions of the air chambers.
Figure 7:
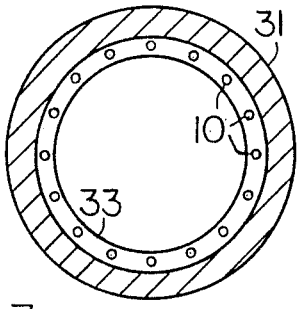
FIG. 7 is a cross-sectional view of the chimney, taken along horizontal line VII—VII of FIG. 6, showing the annular wall and air chambers.
Figure 8:
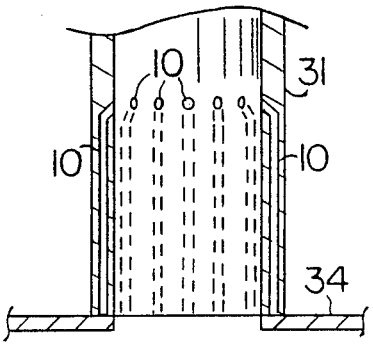
FIG. 8 is a cross-section illustrating the alternative positioning of the air chambers in a chimney.

In the industrial situation involving large, high temperature furnaces and incinerators, the air chambers 10 are situated in the lower walls of the chimney 31 itself, as shown in FIGS. 6 through 8. These figures show a representative industrial application with a large furnace 34 and a tall, large volume chimney 31. The individual air chambers 10 are structured so that the only opening is at the top. As before, the heat transferred from the furnace 34 heats the air contained within the air chambers 10. This high temperature air then rises into the chimney 31, increasing the overall drafting effect. The high temperature air is replaced by the relatively cooler, draft inhibiting air, which is now heated.

In one embodiment, the air chambers 10 are situated in an annular wall 33 which is contained within the interior of the chimney 31. The annular wall 33 encompasses the full inner circumference of the chimney 31 so that a maximum number of air chambers 10 are present around the interior wall of chimney 31. The height of the air chambers 10 is determined by the particular furnace 34 and chimney 31, and can be as much as eight to ten feet in overall length, with the openings for the air chambers 10 being preferably placed at the height at which cooling allows for the soot and creosote to adhere to the chimney walls. The air chambers 10 therefore not only increase the drafting ability of the chimney 31 due to the air exchange effect of replacing relatively cool air with high temperature air, but also act to prevent the accumulation of the hazardous by-products by increasing the temperature of the chimney walls in the lower regions. As seen in FIG. 8, the air chambers can also be placed within the chimney walls without the need for an added annular wall 33, by angling the upper portion of the air chamber 10 so that the opening is flush with the inner wall of the chimney 31. Furthermore, as discussed in the fireplace application, the air chambers 10 can also be metal pipes added on to existing chimneys 31 to produce the same drafting effects.

Experimentation was made with a digital heat probe and air chambers of one inch diameter centered in a four inch wall of aggregate pumice material. Over a period of time of one hour and twenty minutes, with a inner firewall temperature average of 700 degrees, the fireside wall temperature of the air chambers rose from room temperature to 120 degrees and the far side wall temperature of the air chambers rose to only 97 degrees, while the outside firewall temperature remained at an average of 73 degrees. In another test, using an inner firewall temperature of 1000 degrees, the air temperature inside the air chambers reached 140 degrees.

The above examples are by way of illustration only, and one skilled in the art may be aware of obvious substitutions or equivalents. The full scope and definition of the invention, therefore, is to be as set forth in the following claims.

I claim:

1. In a fireplace construction having a firebox, a smoke chamber and a chimney, the improvement comprising:

a plurality of elongated, vertical air chambers located in the firebox, each said air chamber having an upper end and a lower end, and each said air chamber being open only at the upper end, said lower end of each said air chamber being closed, where said upper end of each said air chamber opens into the interior of the fireplace construction;

where the air contained within said air chambers rises into the interior of the fireplace construction when heated and is replaced by relatively cooler air drawn only from the interior of the fireplace construction.

2. The improvement of claim 1, where said upper end of each said air chamber opens into the smoke chamber of the fireplace construction, and said cooler air is drawn only from said smoke chamber.

3. The improvement of claim 2, where said air chambers are located within the walls of the firebox.

4. The improvement of claim 3, where said air chambers are cylindrical in shape.

5. The improvement of claim 4, where said air chambers are approximately one inch in diameter.

6. The improvement of claim 2, where said air chambers are attached to the wall of the firebox.

7. The improvement of claim 6, where said air chambers are made of metal pipes.

8. The improvement of claim 1, where said upper end of each said air chamber opens into the chimney of the fireplace construction, and said cooler air is drawn only from said chimney.

9. In a furnace for burning materials, the furnace having a chimney, the improvement comprising:

a plurality of elongated, vertical air chambers located in the chimney, each said air chamber having an upper end and a lower end, and each said air chamber being open only at the upper end, said lower end of each air chamber being closed, where said upper end of each said air chamber opens into the interior of the chimney;

where the air contained within said air chambers rises into the chimney when heated and is replaced by relatively cooler air drawn only from the chimney.

10. The improvement of claim 9, where said air chambers are contained within an annular wall adjoining the interior of the chimney.

11. The improvement of claim 10, where said air chambers are cylindrical in shape.

12. The improvement of claim 9, where said air chambers are contained within the walls of the chimney.

13. The improvement of claim 12, where said air chambers are substantially cylindrical in shape with an angled upper portion.

14. The improvement of claim 9, where said air chambers are made of metal pipes attached to the interior of the chimney.

15. The improvement of claim 9, where said upper ends of said air chambers are located at the height in the chimney where by-product accumulation begins to occur.

* * * * *